US007084824B2

(12) United States Patent
Mendenhall et al.

(10) Patent No.: US 7,084,824 B2
(45) Date of Patent: Aug. 1, 2006

(54) ANTENNA SYSTEM UTILIZING TOP LOADING WIRES HAVING ADJUSTABLE ELECTRICAL LENGTHS

(75) Inventors: Geoffrey Norman Mendenhall, Cincinnati, OH (US); Jay C. Adrick, Madeira, OH (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/963,207

(22) Filed: Oct. 12, 2004

(65) Prior Publication Data

US 2005/0057425 A1 Mar. 17, 2005

Related U.S. Application Data

(63) Continuation-in-part of application No. 10/407,709, filed on Apr. 4, 2003, now Pat. No. 6,873,300.

(51) Int. Cl.
*H01Q 9/00* (2006.01)

(52) U.S. Cl. ..... 343/750
(58) Field of Classification Search ..... 343/750, 343/847, 874, 852
See application file for complete search history.

(56) References Cited

U.S. PATENT DOCUMENTS 2,998,604 A 8/1961 Seeley
3,386,098 A 5/1968 Mullaney
3,419,873 A 12/1968 Tanner et al.
3,482,249 A 12/1969 Mullaney
3,742,511 A * 6/1973 Smith et al. ..... 343/750
4,670,760 A * 6/1987 Biby ..... 343/832
6,515,632 B1 * 2/2003 McLean ..... 343/741
6,567,057 B1 * 5/2003 Sievenpiper et al. ..... 343/909
6,608,598 B1 * 8/2003 Gee et al. ..... 343/749

OTHER PUBLICATIONS

"Ground Systems as a Factor in Antenna Efficiency", by G. H. Brown, R. F. Lewis and J. Epstein in the Proceedings of the Institute of Radio Engineers, vol. 25, No. 6, Jun. 1937.
"AM Broadcast Antennas with Elevated Radial Ground Systems", by A. Christman and R. Radcliff at 0018-9316/88/0300-0075$01.00, Copyright, 1988 IEEE, pp. 75-77.

* cited by examiner

*Primary Examiner*—Wilson Lee
*Assistant Examiner*—Minh Dieu A

(74) *Attorney, Agent, or Firm*—Tarolli, Sundheim, Covell & Tummino LLP

(57) ABSTRACT

An antenna system is presented herein. This includes an electrically conductive vertical mast radiator. A plurality of top loading electrically conductive wires extend from the radiator. Each wire has an inner end electrically connected to the radiator and an outer end located away from the radiator. The electrical length from the radiator to the outer end of each wire is adjustable to vary the operating frequency of the antenna system.

17 Claims, 3 Drawing Sheets

ANTENNA SYSTEM UTILIZING TOP LOADING WIRES HAVING ADJUSTABLE ELECTRICAL LENGTHS

RELATED APPLICATIONS

This application is a continuation-in-part of U.S. patent application Ser. No. 10/407,709, filed Apr. 4, 2003, now U.S. Pat. No. 6,873,300 and entitled "An Antenna System Utilizing Elevated, Resonant, Radial Wires".

BACKGROUND OF THE INVENTION

1. Technical Field

The present invention relates to the art of RF broadcasting antenna systems and, more particularly, to such a system employing a vertically oriented radiator together with a plurality of top loading wires extending therefrom, the electrical length of the wires being adjustable so that the antenna may be resonated over a wide range of operating frequencies.

2. Description of the Prior Art

Antenna systems employing an electrically conductive vertical radiator, together with top loading wires extending outward from the radiator have been known in the art. Such top loading wires have been used to increase the electrical length of such a vertical radiator and to lower its self-resonance at a particular frequency. Such a system is disclosed, for example, in the above-referenced U.S. patent application.

It is to be noted, however, that the above-noted patent application does not disclose that the top loading wires may be adjusted so as to vary the electrical length thereof whereby the antenna may be adjusted to resonate at different frequencies over a wide area. This permits a fixed length, short, and vertical antenna to be used over a range of frequencies without adding a series inductor to the antenna which would reduce the operating bandwidth and add losses and result in a higher voltage at the base of such an antenna. The use of top loading wires of variable electrical lengths improves bandwidth, reduces losses and improves the system efficiency by increasing the radiation resistance of the antenna.

SUMMARY OF THE INVENTION

In accordance with one aspect of the present invention, there is provided an antenna system that includes an electrically conductive vertical mast radiator. Also, a plurality of top loading electrical conductive wires extend from the radiator. Each wire has an inner end electrically connected to the radiator and an outer end that is located away from the radiator. The electrical length of each wire, as measured from the radiator to the outer end, is adjustable to thereby vary the operating frequency of the antenna system.

In accordance with another aspect of the invention, the system includes a vertical radiator mast of electrically conductive material that extends generally in a vertical direction relative to earth ground. The mast has a lower end for receiving RF energy for radiation thereby at an operating RF frequency, and having an upper end. A plurality of top loading electrically conductive wires is provided. Each wire has an inner end and an outer end with the outer end being spaced radially outward from the upper end of the mast. An electrically conductive wire guide is provided for each wire. The guide is electrically connected to the mast and is in slidable contact with the wire intermediate its ends so that the wire may be extended and retracted therefrom to vary the electrical length of the wire from the wire guide to the outer end to thereby vary the operating frequency of the antenna system.

BRIEF DESCRIPTION OF THE DRAWINGS

The foregoing and other objects and advantages of the invention will become more readily apparent from the following description as taken in conjunction with the accompanying drawings, wherein.

DESCRIPTION OF THE PREFERRED EMBODIMENTS

Figure 1:
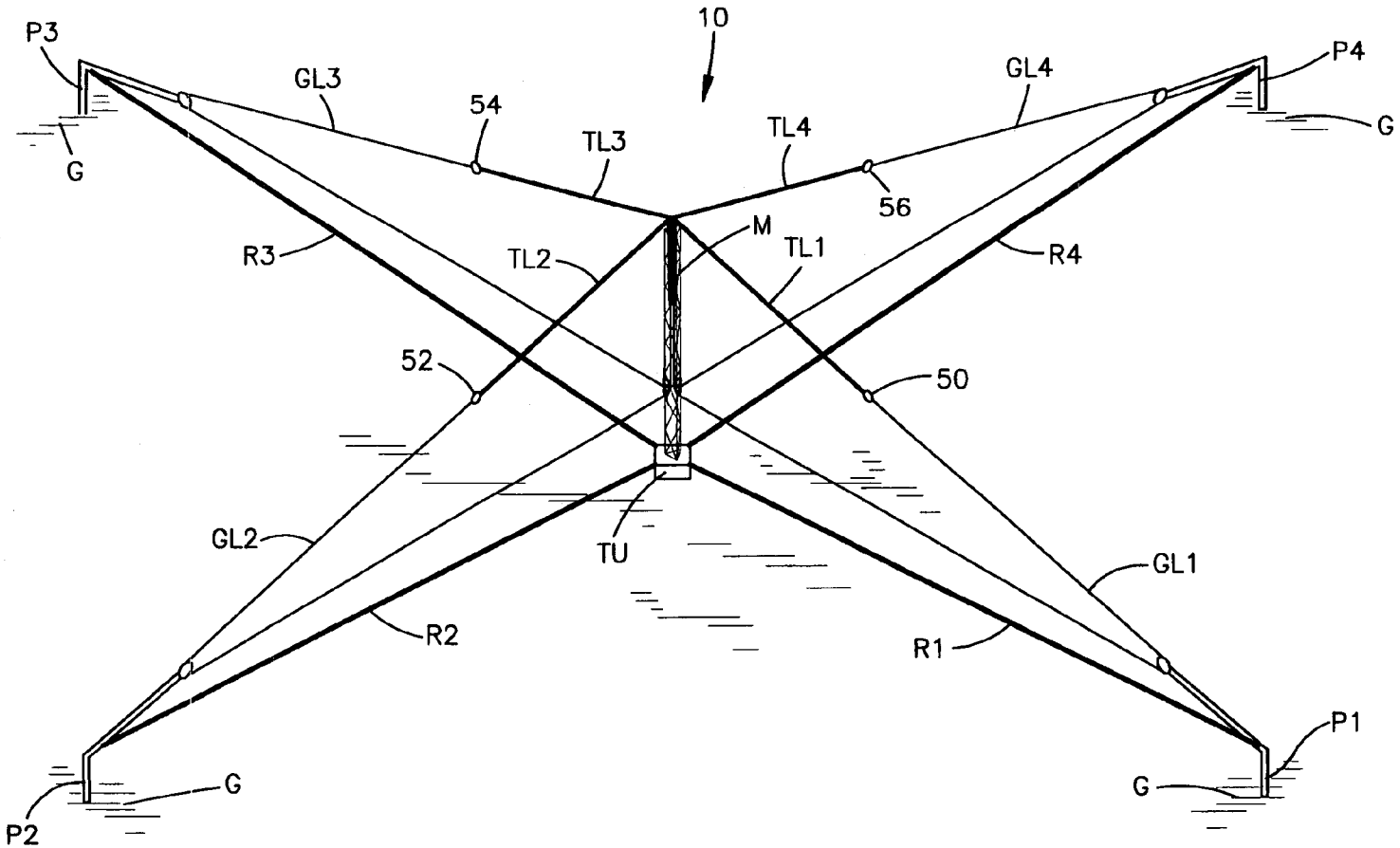
FIG. 1 is an isometric view of an antenna system incorporating the present invention.

Reference is now made to FIG. 1 which illustrates the antenna system 10 constructed in accordance with the present invention. The following is a brief overall description of the antenna system. The description will be followed by a detailed description of the structural and electrical features of the antenna system.

As shown in FIG. 1, the antenna system 10 includes a vertically extending, electrically conductive mast M which extends upwardly from a tuning unit TU. The mast terminates at an upper end from which extends four radially extending top loading wires TL1, TL2, TL3 and TL4. Four radial wires R1, R2, R3 and R4 extend radially outward from the mast and protrude from the tuning unit TU. These radial wires are elevated above the level of earth ground G at a level of about ten feet.

The top loading wires, which are made of electrically conductive material such as copper or the like, are placed directly above and in registry with the radial wires. For example, the top loading wire TL1 is in registry with and directly over radial wire R1 so that they define a common vertical plane with the mast M. As viewed from above, the top loading wires are spaced from each other by about 90°. The top loading represents a capacitance to the radial wires to lower the self-resonant frequency of the vertical radiator. The radial wires may be tuned by circuitry within the tuning unit TU and they may resonate at a frequency corresponding to the operating frequency of the vertical radiator. As will be described hereinafter, the electrical length of each of the top loading wires is adjustable to thereby adjust the operating frequency of the antenna system.

The antenna system disclosed herein has an operating frequency in the range from approximately 1200 KHz to approximately 1700 KHz. However, the technology could be applied to systems that operate at much lower and much higher frequencies. The radiation resistance of the antenna system is about ⅓ that of a quarter-wavelength radiator so that minimizing ground resistance is important and this is achieved with the structure as described herein.

The mast M is preferably designed to be of a height that is less than a quarter wavelength of the highest operating frequency above ground level G.

The radial wires R1, R2, R3, and R4 are electrically resonated at the operating frequency.

The outer or far ends of the radial wires R1–R4 are each connected to an insulator and thence to respective mounting poles P1, P2, P3 and P4. These poles are constructed of suitable electrical insulating material and extend from the level of ground upward to an extent of approximately 10 feet and are suitably secured to the ground to provide support. The inner or near ends of the radial wires R1–R4 extend through insulators located in the respective sidewalls of the tuning unit TU. These wires may extend inwardly of the tuning unit and are connected together in common and thence through an adjustable series inductor to ground. This inductor is employed for adjusting the operating frequency of the radial system. As stated before, additional adjustment of this operating frequency is obtained by varying the electrical length of each of the top loading wires TL1–TL4.

The vertical mast M extends upwardly from the tuning unit TU and is suitably secured thereto. The tuning unit may take the form of a metal box having sidewalls, a floor and a roof. The mast may be secured with suitable insulated mechanical connections. Although not shown in the drawings, the lower end of the mast may be connected via the antenna tuning unit to a coaxial transmission line that extends from the tuning unit to a transmitter.

In accordance with the present invention, the electrical length of each of the top loading lines TL1–TL4 may be varied to thereby adjust the operating frequency of the antenna system so that the antenna system may be used over a wide range of frequencies. Variable electrical length top loading wires may reduce the need to employ a series inductor. Also reducing the reliance on such a series inductor or the elimination thereof may reduce losses and improve the system efficiency and bandwidth by increasing the radiation resistance of the antenna.

Figure 2:
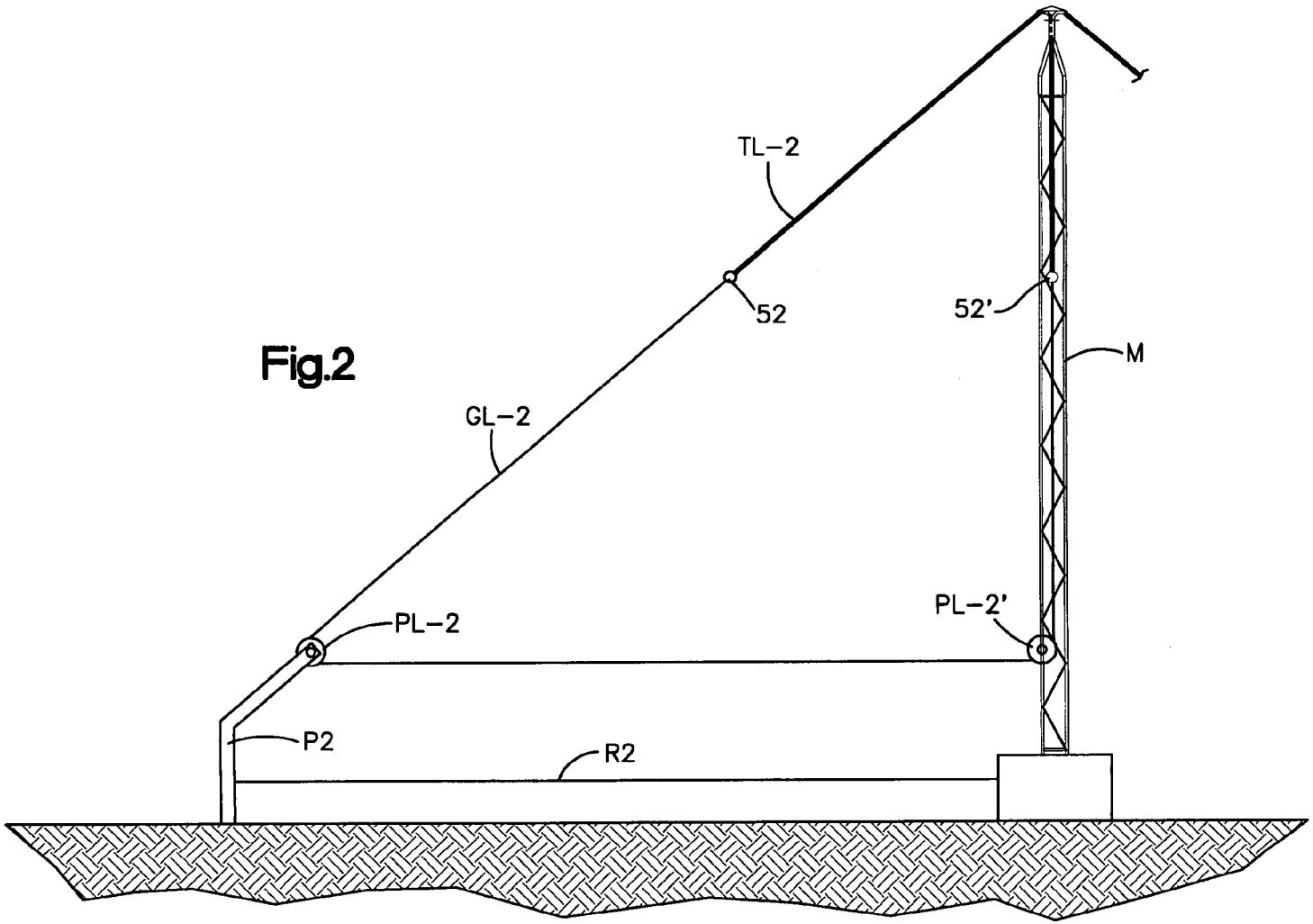
FIG. 2 is an elevational view showing a portion of the system illustrated in FIG. 1.
Figure 3:
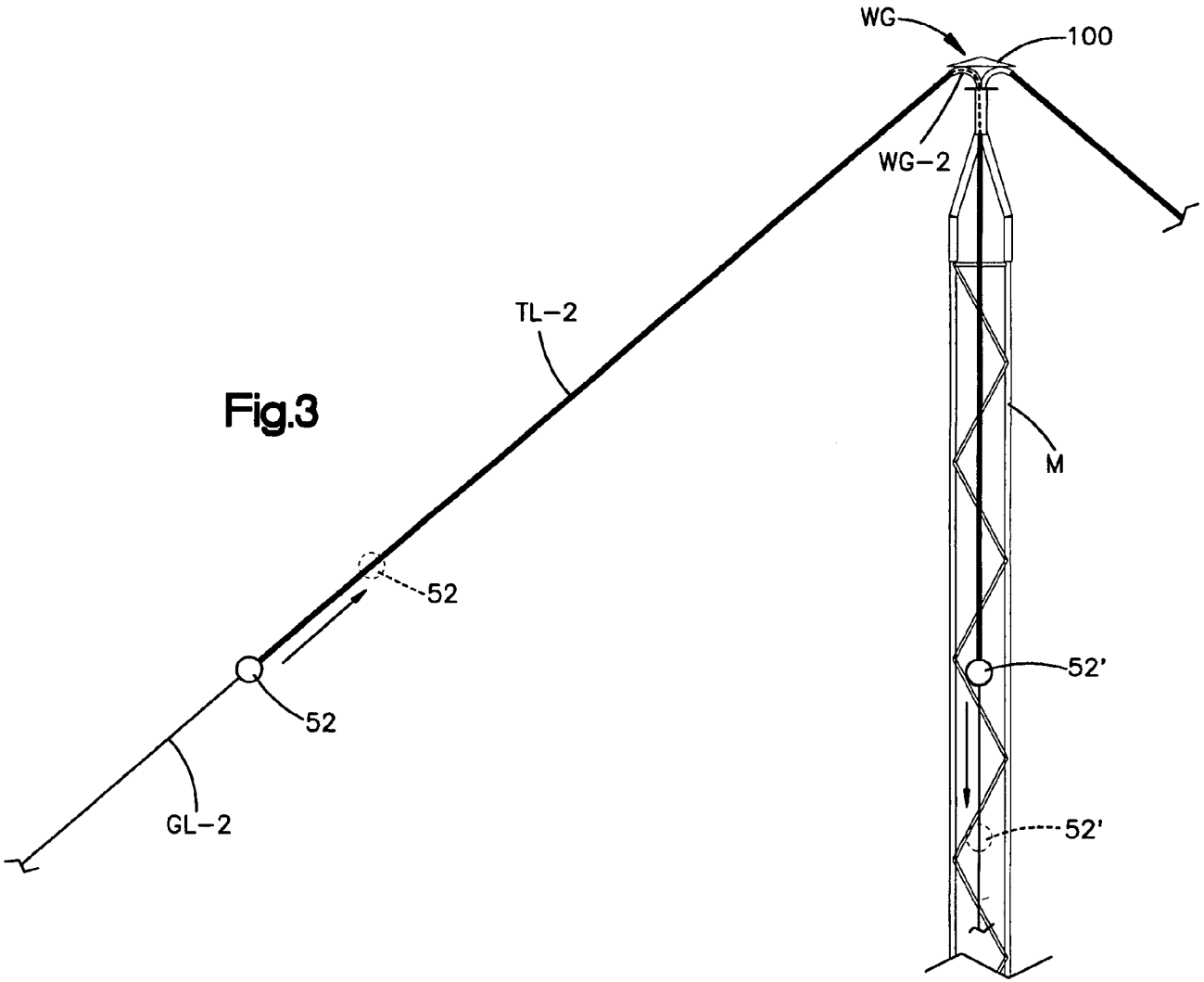
FIG. 3 is an enlarged view of a portion of that illustrated in FIG. 2.

The features that permit this operation are described hereinbelow with emphasis on the features illustrated in FIGS. 2 and 3. The top loading wires TL1–TL4 may each be of a length on the order of 0.08 wavelength of the intended operating frequency. However, the electrical length is adjustable to produce electrical resonance over a wide range of operating frequencies. The far end of each wire terminates in a connection to an insulator and then extends with a non-conductive guy wire, such as a nylon rope, to one of the posts P1–P4. Thus, the top loading wire TL1 (FIG. 1) is connected at its far or outer end to a suitable insulator 50 which is, in turn, connected to a guy line GL1. Similarly, the top loading wire TL2 terminates at an insulator 52 which, in turn, is connected to a guy line GL2. Similarly, the top loading wire TL3 terminates at its outer end to an insulator 54 and thence to a guy line GL3. Also, the top loading wire TL4 has its outer end connected to an insulator 56 which is connected to a guy line GL4. Each of the guy lines connect the outer end of a respective top loading wire with the inner end of the same top loading wire by means of a second insulator forming a guy line-wire loop arrangement. A portion of the length of each guy line is wrapped about a pair of non-conductive pulleys. One pulley is mounted to one of the posts P1–P4 and the other is mounted to the lower end of the mast M. This is best illustrated in FIG. 2, with respect to the guy line-loop arrangement including guy line GL2 and top loading wire TL-2. This arrangement includes the guy line interconnected at one end with the outer end of the top loading wire TL-2 by means of an insulator 52 and at the other end to the inner end of the top loading wire TL-2 by means of a second insulator 52'. The loop arrangement including guy line GL-2 is wrapped about a pulley PL-2 mounted to the post P2 and a second pulley PL-2' mounted to the mast M. These pulleys are preferably constructed of non-conductive material and are mounted in any suitable manner to the post P2 and to the mast M. The pulleys are mounted at a height slightly more than ten feet above earth ground to allow easy access to the associated guy line for adjustment thereof. The adjustment may be manual or motorized, for example.

The electrically conductive top loading wire portion of each guy line-wire loop arrangement is in slidable electrical contact with the wire guide WG mounted on the upper end of the mast M. This wire guide includes a tubular wire guide member associated with each guy line-wire loop arrangement. Thus, as shown in FIG. 3, a portion of the length of the top loading wire TL-2 is threaded through the tubular guide WG-2 so that it makes sliding and electrical engagement with the guide while the guy line-wire loop arrangement is extended and retracted therethrough. This varies the electrical length of the top loading wire as measured from the wire guide WG to the far or outer end of the top loading wire such as at insulator 52 associated with top loading wire TL-2. This wire guide has a top hat arrangement that covers the upper end of the wire guide. A conductive bonding wire may connect the top hat arrangement with the mast M.

The mast M is constructed of electrically conductive material such as three vertical metal bars that are interconnected with reinforcing metal cross members to provide a three-sided structure. A rain cover may be wrapped about the mast from the tuning unit TU to the upper end of the mast.

Although the foregoing has been described in conjunction with the preferred embodiment, it is to be appreciated that various modifications may be made without departing from the spirit and scope of the invention as defined by the appended claims.

Having described the invention, I claim the following:

1. An antenna system comprising:

an electrically conductive vertical mast radiator;

a plurality of top loading electrically conductive wires that extend from said radiator, each said wire having an inner end and an outer end located away from said radiator;

an electrically conductive wire guide for each said wire, said guide being electrically connected to said mast and being in slidable contact with said wire intermediate its said ends so that said wire may be extended and retracted therefrom to thereby vary the electrical length of said wire from said wire guide to said outer end to thereby vary the operating frequency of said antenna system.

2. An antenna system as set forth in claim 1 wherein said outer end of each said wire is connected to the inner end thereof by a non-conductive guy line to thereby define a continuous guy line-wire loop arrangement.

3. An antenna system as set forth in claim 2 wherein the outer end of each said wire is connected to one end of said guy line by means of an insulator.

4. An antenna system as set forth in claim 2 wherein the inner end of each said wire is connected to one end of said guy line by means of an insulator.

5. An antenna system as set forth in claim 2 wherein said inner end and said outer end are connected to opposite ends of said guy line by means of a pair of spaced apart insulators.

6. An antenna system as set forth in claim 1 wherein a portion of the length of said guy line is wrapped about a pulley so that said guy line-wire loop arrangement may be adjusted to vary the length of said wire.

7. An antenna system as set forth in claim 6 wherein the outer end of each said wire is connected to one end of said guy line by means of an insulator.

8. An antenna system as set forth in claim 6 wherein the inner end of each said wire is connected to one end of said guy line by means of an insulator.

9. An antenna system comprising:

a vertical radiator mast of electrically conductive material that extends generally in a vertical direction relative to earth ground, said mast having a lower end for receiving RF energy for radiation thereby at an operating RF frequency and having an upper end;

a plurality of top loading electrically conductive wires, each said wire having an inner end and an outer end spaced radially outward from the upper end of said mast, an electrically conductive wire guide for each said wire, said guide electrically connected to said mast and being in slidable contact with said wire intermediate its said ends so that said wire may be extended and retracted therefrom to thereby vary the electrical length of said wire from said wire guide to said outer end to thereby vary the operating frequency of said antenna system.

10. An antenna system as set forth in claim 9 wherein said outer end of each said wire is connected to the inner end thereof by a guy line to thereby define a continuous guy line-wire loop arrangement.

11. An antenna system as set forth in claim 10 wherein said guy line is constructed of non-electrically conductive material.

12. An antenna system as set forth in claim 11 wherein the outer end of each said wire is connected to one end of said guy line by means of an insulator.

13. An antenna system as set forth in claim 12 wherein the inner end of each said wire is connected to one end of said guy line by means of an insulator.

14. An antenna system as set forth in claim 10 wherein the inner end and the outer end of each said wire are respectively connected to opposite ends of said guy line by a pair of spaced apart insulators.

15. An antenna system as set forth in claim 10 wherein a portion of the length of each said guy line is wrapped about a pulley so that said guy line-wire loop arrangement may be adjusted to vary the electrical length of said wire.

16. An antenna system as set forth in claim 15 wherein the outer end of each said wire is connected to one end of said guy line by means of an insulator.

17. An antenna system as set forth in claim 15 wherein the inner end of each said wire is connected to one end of said guy line by means an insulator.

* * * * *